US010954752B2

(12) United States Patent
Manson et al.

(10) Patent No.: US 10,954,752 B2
(45) Date of Patent: Mar. 23, 2021

(54) IMPRESSION TOOL AND METHODS OF USE

(71) Applicant: PEAK WELL SYSTEMS PTY LTD, Bayswater (AU)

(72) Inventors: David John Copeland Manson, Bayswater (AU); Gareth Brown, Bayswater (AU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1116 days.

(21) Appl. No.: 14/813,350

(22) PCT Filed: Jan. 31, 2014

(86) PCT No.: PCT/GB2014/050262
§ 371 (c)(1),
(2) Date: Jul. 30, 2015

(87) PCT Pub. No.: WO2014/118555
PCT Pub. Date: Aug. 7, 2014

(65) Prior Publication Data

US 2016/0102527 A1 Apr. 14, 2016

(30) Foreign Application Priority Data

Jan. 31, 2013 (AU) ..... 2013900314

(51) Int. Cl.
*E21B 47/098* (2012.01)
*E21B 41/00* (2006.01)
*E21B 31/00* (2006.01)

(52) U.S. Cl.
CPC ..... *E21B 41/00* (2013.01); *E21B 31/00* (2013.01); *E21B 47/098* (2020.05)

(58) Field of Classification Search
CPC ..... E21B 41/00; E21B 31/00; E21B 47/0915; E21B 47/00; E21B 47/09
See application file for complete search history.

(56) References Cited

U.S. PATENT DOCUMENTS 2,824,378 A 2/1958 Stokes
2003/0173075 A1* 9/2003 Morvant ..... E21B 43/08 166/230
2004/0168806 A1* 9/2004 Booth ..... E21B 37/02 166/311

(Continued)

FOREIGN PATENT DOCUMENTS

CA 2 434 770 A1 1/2005
WO WO 2014077697 * 5/2014 ..... E21B 47/09

OTHER PUBLICATIONS https://www.thefreedictionary.com/knitted.*

(Continued)

*Primary Examiner* — Yong-Suk (Philip) Ro
(74) *Attorney, Agent, or Firm* — Eileen Pape

(57) ABSTRACT

An impression tool for providing an impression of an object in a borehole includes a block held by a gripper. The block has a plurality of discrete elements that can deform or move so as to create an impression of an impacted object. The bock can be formed of knitted wire mesh. The tool is impacted on an object such that an impression is formed in the block.

32 Claims, 7 Drawing Sheets

(56) References Cited

U.S. PATENT DOCUMENTS

| | | | |
|---|---|---|---|
| 2009/0195647 | A1 | 8/2009 | Lynde |
| 2010/0212890 | A1 | 8/2010 | Lund |
| 2013/0207301 | A1 | 8/2013 | Guidry et al. |

OTHER PUBLICATIONS https://www.bing.com/search?q=loop+definition&go=Search&qs=ds&form=QBRE.*
Aug. 6, 2014 Combined Search & Examination Report issued in British Application No. 1401641.4.
Dec. 22, 2014 International Search Report issued in PCT Application No. PCT/GB2014/050262.
Dec. 22, 2014 Written Opinion issued in PCT Application No. PCT/GB2014/050262.
International Preliminary Report on Patentability issued in PCT Application PCT/GB2014/050262, dated Aug. 4, 2015 (8 pages).
Examination report issued in AU Application 2014210965, dated Jan. 19, 2017 (3 pages).

* cited by examiner

IMPRESSION TOOL AND METHODS OF USE

The present invention relates to an impression tool suitable for obtaining an impression of an object within a borehole, a method of obtaining an impression of an object in a borehole, and a method of retrieving an object from a borehole. Aspects of the invention relate to a method of forming an impression tool and a kit of parts for assembling an impression tool.

BACKGROUND TO THE INVENTION

In the oil and gas industry strings of tools are lowered down a borehole of a well. Sometimes a tool will break or become stuck or some other form of obstacle may be present in the borehole. In these circumstances it is useful to know what the obstacle is in order to work out how to deal with it or to identify what sort of fishing tool to use to retrieve the broken or stuck tool.

Currently an impression tool is used. It comprises a lead block at its downhole end. The impression tool is dropped down the hole, where it strikes the obstacle or object of interest. The lead block is deformed by the impact leaving an impression in the lead block. The impression tool is then retrieved and the impression can then be examined. The shape of the impression left in the lead block by the object can then be used to identify the object. The impression tool is formed by pouring molten lead into a cavity of a steel housing. The lead is machined to form the impression block. Once used the impression tool can be reused by removing the impression in the face. However, it is not desirable to do this onsite for health safety and environmental reasons so therefore currently re-use of lead impression tools becomes costly.

FIG. 1A is a photograph of a currently used lead impression tool 2 with an impression formed 8 as a result of impact with an object. FIG. 1B is a schematic view of a selection 7 of fishing tools 9*a*, 9*b* to 9*n*, from which a fishing tool to retrieve an object from a borehole according to the impression in the block of the tool is selected.

In some wells the temperature within the borehole can approach the melting point of lead, particularly if the lead is alloyed to lower its melting point. If the lead melts, or if the temperature lowers the tensile strength of the lead, the impression may be lost or the lead block itself may become lost. In some cases it will not be permitted to use lead-based materials in wells which have conditions that approach these sorts of temperatures.

The present invention provides an alternative.

In this specification the terms "comprising" or "comprises" are used inclusively and not exclusively or exhaustively.

SUMMARY OF THE PRESENT INVENTION

According to a first aspect of the present invention there is provided a tool for providing an impression of an object, said tool comprising a block held by a gripper, wherein the block comprises a plurality of discrete elements that deform and/or move so as to create the impression.

In an embodiment the block is configured such that the deformation and/or movement of the elements is characterised by movement of the elements into one or more spaces within the block or behind the impression face of the block.

Preferably the one or more spaces are within a volume occupied by the block.

Preferably the block comprises a wire mesh.

In an embodiment the block comprises a knitted wire mesh. In an embodiment the elements are loops of knitted wire mesh.

In an embodiment the block comprises a plurality of axially movable pins. In an embodiment the elements comprise the pins.

According to one aspect of the present invention there is provided a tool for providing an impression of an object, said tool comprising a block of knitted wire mesh held by a gripper.

In an embodiment the block comprises knitted wire having a gauge in the range of 0.05 mm to 0.5 mm. In an embodiment the wire gauge is in the range of 0.1 mm to 0.2 mm.

In an embodiment the wire gauge is about 0.15 mm.

In an embodiment the block comprises knitted wire having a density in the range of 0.5 to 5 gram/cc. In an embodiment the density is in the range of 1 to 3 gram/cc. In an embodiment the density is about 1.75 gram/cc.

In an embodiment the block comprises knitted wire having a loop size 5 of between 0.5 and 5 mm in diameter. In an embodiment the loop size is about 1-2 mm in diameter.

In an embodiment the block comprises knitted wire having a weft knitting pattern. In an embodiment the block comprises knitted wire having a warp knitting pattern. In an embodiment the block comprises knitted wire having a consistent knit stitch knitting pattern. In an embodiment the block comprises knitted wire having an alternating knit stitch and purl stitch knitting pattern. Alternatively embodiments may comprise knitting patterns which are combinations of the above.

In an embodiment the block is malleable in normal operating conditions. In an embodiment the block is not extrudable in normal operating conditions.

In an embodiment the block comprises an impression portion projecting from the gripper and a grip portion of narrower diameter held by the gripper.

Preferably the block is of substantially cylindrical form, which may be formed by rolling a wire mesh.

In an embodiment the block is formed by rolling a tube of knitted mesh into a substantially cylindrical form. In an embodiment the grip portion of the block is formed by compressing a part of the cylindrical roll of knitted mesh into a smaller stepped cylindrical shape.

In an embodiment the gripper comprises a carrier having a channel into which the grip portion can be received.

In an embodiment the gripper further comprises a plurality of clamps received within corresponding slots in the carrier, such that the clamps grip the grip portion when forced radially inward.

In an embodiment each clamp is arc shaped with a plurality is inwardly directed teeth.

In an embodiment the gripper further comprises a sleeve into which the carrier and clamps are received, such that when radially disposed in relation to the clamps the sleeve forces the clamps radially inward.

The tool may comprise a protective element for the block, which may comprise a skirt member. The skirt member may at least partially surround the block.

Preferably the skirt member at least partially surrounds an impression portion of the block, and may extend axially at least partially over an impression portion of the block.

Preferably the skirt member extends axially along the impression portion so that the edge of the skirt member is flush with an impression face of the block.

The protective element is preferably provided with an engaging formation which secures the protective element into the gripper. Where the protective element comprises a skirt member, the engaging formation may comprise a lip which extends radially inward from a main inner diameter of the skirt member.

The protective element may be configured to direct impact forces experienced in use to the gripper.

The protective element is formed from a material selected to be malleable in normal operating conditions. In one embodiment, the protective element is formed from aluminium.

According to a second aspect of the present invention there is provided a block of knitted wire mesh with a grip portion suitable for being gripped by a gripper of a tool for providing an impression of an object, and an impact portion suitable for impacting an object so as to create an impression in the block.

Embodiments of the second aspect of the invention may include one or more features of the first aspect of the invention or its embodiments, or vice versa.

Also according to the present invention there is a method of obtaining an impression of an object, said method comprising: providing a tool comprising a block of knitted wire mesh held by a gripper; and impacting the block on the object such that an impression is formed in the block.

According to one aspect of the present invention there is provided a tool for providing an impression of an object, said tool comprising a plurality of axially movable pins arranged to move so as to conform with a surface of the object and so as to create the impression defined by the moved ends of the pins.

In an embodiment the pins are provided with gaps there between. In an embodiment there is a gap within the tool into which moved pin may be accommodated.

In an embodiment the pins have a frictional coupling that resists movement such that the pins, once moved are retained in their moved position.

According to a third aspect of the invention, there is provided a kit of parts for assembling an impression tool according to claim 1, the kit comprising:

a block comprising a plurality of discrete elements that deform or move so as to create an impression of an object in a borehole; and a gripper to hold the block.

The kit of parts may comprise a protective element for the block. The kit of parts may further comprise a protective an assembly tool, the assembly tool comprising an anti-swage ring for the protective element during assembly of the block into the gripper.

Embodiments of the third aspect of the invention may include one or more features of the first or second aspects of the invention or their embodiments, or vice versa.

According to a fourth aspect of the invention, there is provided a method of assembling an impression tool for providing an impression of an object in a borehole, the method comprising:

providing a block comprising a plurality of discrete elements plurality of discrete elements that deform or move so as to create an impression of an object in a borehole; providing a gripper;

inserting the block into the gripper;

securing the block into the gripper.

The method may comprise providing a protective element for the block, and may comprise assembling the protective element with the gripper. Preferably the method comprises inserting the block into the gripper through the protective element.

The method may comprise providing an assembly tool comprising an anti-swage ring, and may comprise locating the protective element in the anti-swage ring. Preferably the method comprises inserting the block into the gripper through the anti-swage ring and the protective element.

Embodiments of the fourth aspect of the invention may include one or more features of the first to third aspects of the invention or their embodiments, or vice versa.

According to an fifth aspect of the present invention there is a method of obtaining an impression of an object, said method comprising: providing a tool comprising a block comprising a plurality of discrete elements that deform or move so as to create the impression; and impacting the block on the object such that an impression is formed in the block.

The method may comprise retrieving the tool from the borehole.

Embodiments of the fifth aspect of the invention may include one or more features of the first to fourth aspects of the invention or their embodiments, or vice versa.

Also according to the present invention there is a method of obtaining an impression of an object, said method comprising: providing a tool comprising a plurality of axially movable pins; and impacting the block on the object such that an impression is formed in the block.

According to a sixth aspect of the present invention, there is provided a method of retrieving an object from a borehole, the method comprising:

obtaining an impression of the object according to the method of claim xx;

retrieving the tool from the borehole;

inspecting the impression in the block of the tool;

selecting a fishing tool according to the impression in the block of the tool; and retrieving the object from the borehole using the fishing tool.

Embodiments of the sixth aspect of the invention may include one or more features of the first to fifth aspects of the invention or their embodiments, or vice versa.

BRIEF DESCRIPTION OF THE DRAWINGS

In order to provide a better understanding of the present invention preferred embodiments will now be described, by way of example only, with reference to the accompanying drawings, in which.

DETAILED DESCRIPTION OF PREFERRED EMBODIMENTS

In a general form there is a tool for providing an impression of an object, said tool comprising a block held by a gripper, wherein the block comprises a plurality of discrete elements that deform or move so as to create the impression. In an embodiment the block is configured such that the deformation or movement of the elements is characterised by movement of the elements into one or more spaces within the block or behind the impression face of the block.

Figure 1A:
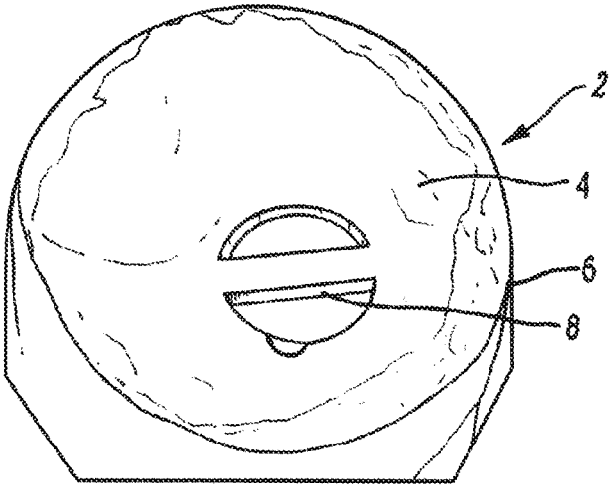
Fig. 1A (Prior Art)
FIG. 1A is a photograph of a currently used lead impression tool with an impression formed as a result of impact with the object.
Figure 1B:
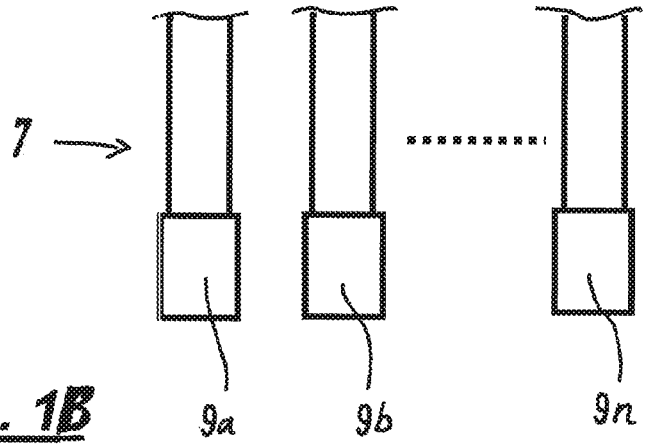
Fig. 1B (Prior Art)
FIG. 1B is a schematic view of a plurality of fishing tools.
Figure 2:
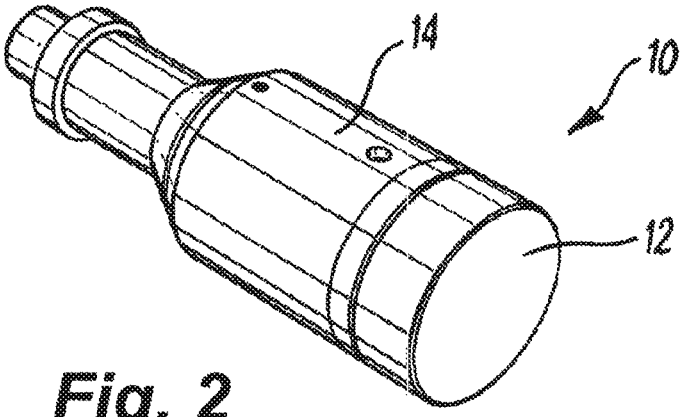
FIG. 2 is perspective view of an embodiment of an impression tool according to the present invention.
Figure 3:
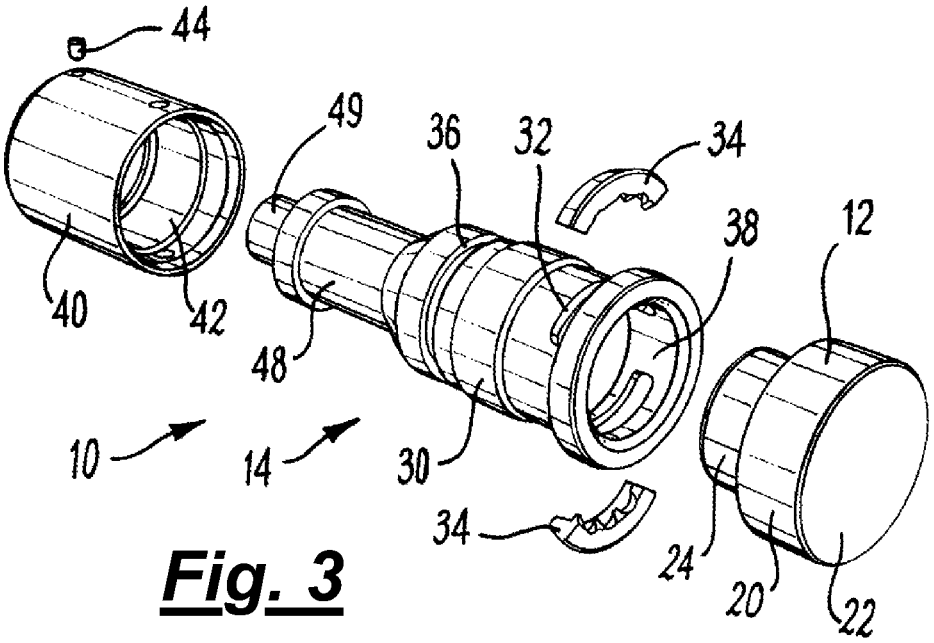
FIG. 3 is an exploded perspective view of the tool of FIG. 2.
Figure 4:
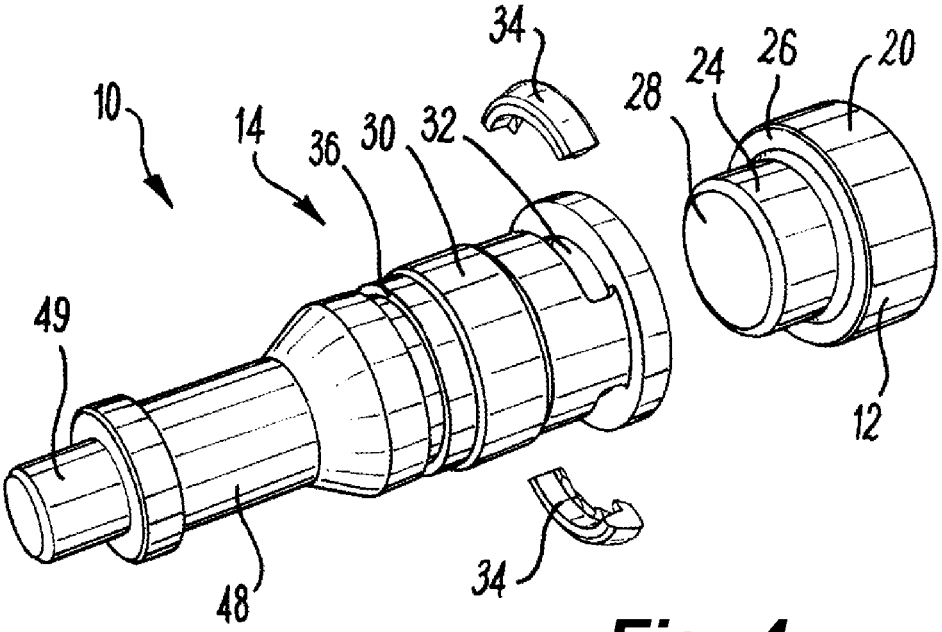
FIG. 4 is a rear exploded perspective view of the tool of FIG. 2.
Figure 5:
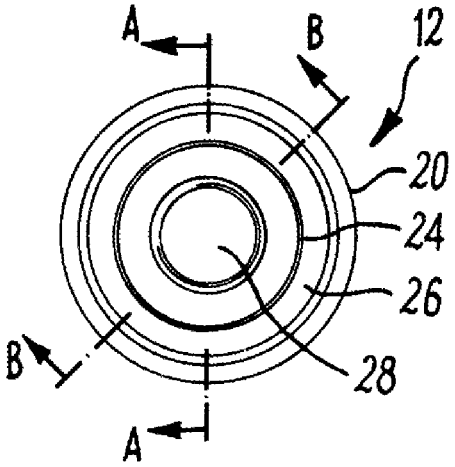
FIG. 5 is an end elevation of a block of the tool of FIG. 2 through the cross section CC of FIG. 8.
Figure 6:
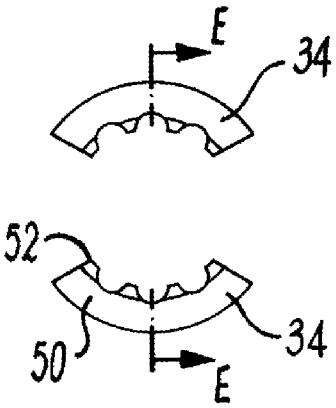
FIG. 6 is an end elevation of a pair of clamps of the tool of FIG. 2.
Figure 7:
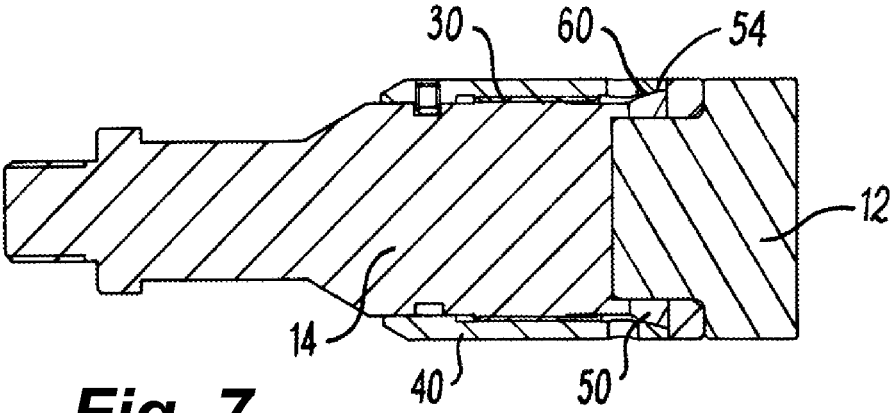
FIG. 7 is a cross-sectional elevation of the tool of FIG. 2 through the section A-A of FIG. 5.
Figure 8:
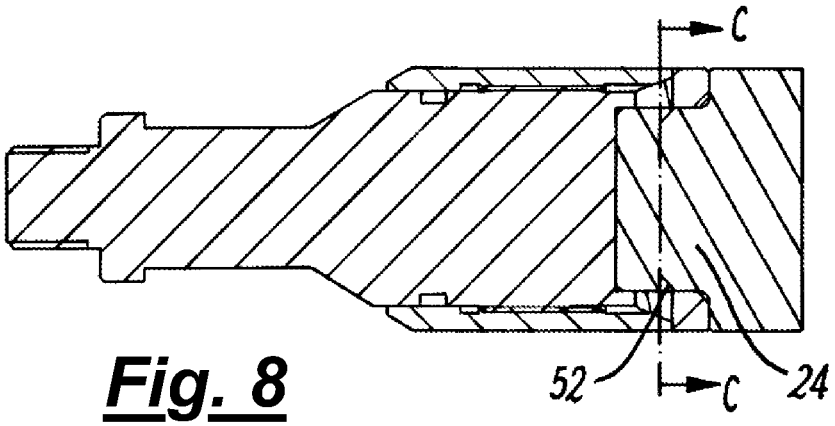
FIG. 8 is a cross-sectional elevation of the tool of FIG. 2 through the section B-B of FIG. 5.
Figure 9:
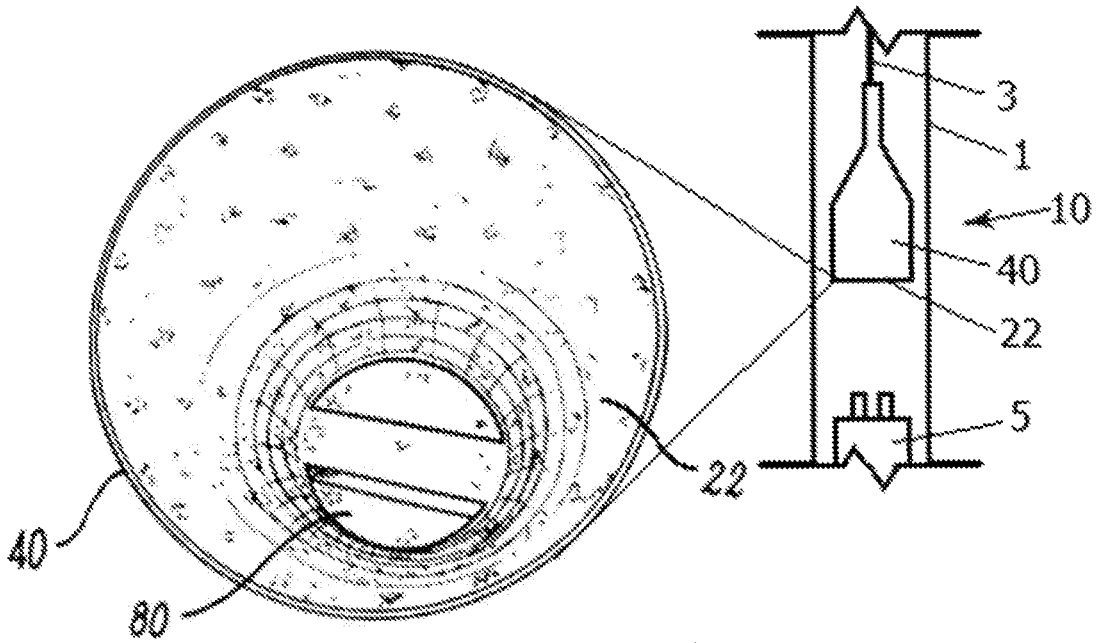
FIG. 9 is an opposite end view of the block of the tool of FIG. 2, where the tool has been used to obtain an impression of an object in a borehole.
Figure 10:
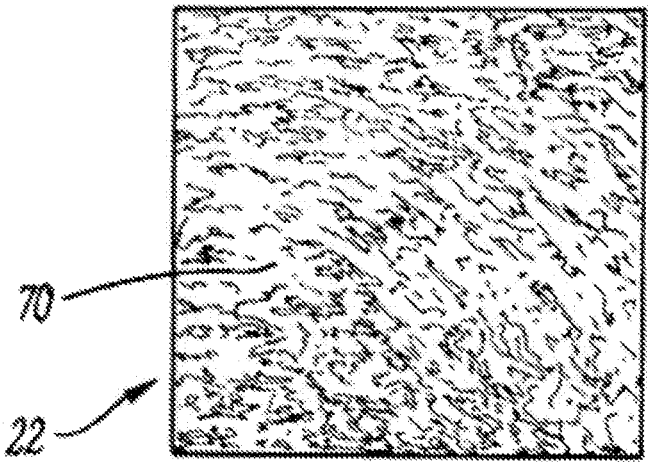
FIG. 10 is an enlarged view of a portion of the block of FIG. 9.

Referring to FIGS. 2 to 10 there is shown a tool 10 for providing an impression of an object 5. The tool comprises a block 12 of knitted wire mesh held by a gripper 14. The knitted wire mesh block 12 comprises wire having a gauge of 0.05 mm to 0.5 mm, preferably 0.1 mm to 0.2 mm and most preferably about 0.15 mm, knitted with a loop size of about 1 to 2 mm in diameter, in a simple weft knitting pattern. Other knitting patterns may be used. The block 12 is shaped, such as by rolling, into a generally cylindrical shape. In an embodiment the wire is stainless steel. The knitting of the wire gives air gaps in the block, which allow flexibility in the mesh to be deformed. The malleability of the wire allows deformations to be retained in the block. The mesh has a small resilience, which if overcome, such as by an impact, become a retained deformation. Thus the block is malleable, but not extrudable, in normal operating conditions. The block has a density of 0.5 to 5 gram/cc, preferably 1 to 3 gram/cc and most preferably about 1.75 gram/cc. There is an air gap between the strands of wire forming the mesh. FIG. 10 shows the rolled layers 70 of the knitted mesh. The knitted mesh block may be formed from a material of the type used in an expansion or back-up ring in a permanent plug.

The block 12 is shaped to have a wider impression portion 20 with an impact face 22 at one end and narrower grip portion 24 with an internal face 28. The impression portion 20 is stepped at 26 from the grip portion 24. The grip portion 24 may be formed by compressing part of the cylinder of rolled mesh.

The gripper 14 comprises an elongate carrier 30 having a hole or channel 38 at an end into which the grip portion 24 can be received. In an embodiment the gripper 14 further comprises a plurality of clamps 34 received within radially extending corresponding slots 32 in the carrier 30, such that the clamps 34 grip the grip portion 24 when forced radially inward.

In an embodiment each clamp 34 has an arc shaped body 50 with a cylindrical segment outer surface, in one embodiment, and an inner surface, in an embodiment, having a shape of a frustoconically shaped segment 54. In an embodiment the clamp has a plurality of inwardly directed teeth 52 to bite into the grip portion 24 to tightly hold the block 12 within the gripper 14.

In an embodiment the gripper 14 further comprises a sleeve 40 having an inside 42 into which the carrier 30 and clamps 34 are received, such that when radially disposed in relation to the clamps 34 the sleeve 40 forces the clamps 34 radially inward so as to hold the grip portion 24. This is achieved by the end portion 60 of the sleeve having a frustoconical shape, such that the end portion 60 and segment 54 of the respective clamp 34 form a wedge that drives the clamp 34 radially inward as the sleeve is axially moved over the clamps 34. The sleeve 40 has a locking screw 44 to hold it in position.

The gripper 14 is further provided with a connection neck 48 and/or a threaded end portion 49, such that the tool 10 may be connected to a tool string in operation.

In operation the tool 10 is lowered down a borehole 1 tethered to a cable or wire 3, such as a slickline, with the block 12 being down-hole first. When the tool 10 encounters an object 5 the impact into the block 12 will deform the malleable impression face 22 such that an impression, such as impression 80, is left in the block 12. The tool 10 can then be retrieved and the impression examined to identify the impacted object 5.

It can be seen that the example impression 80 in an embodiment of the present invention is comparable to the impression 8 in a prior art impression tool 2 formed of a lead block 4 in a steel housing 6. However, as the wire gauge and density of the mesh can be selected, the malleability of the tool can be selected, which in turn enables selection of the level of detail that may be held by the impression. A benefit of this is that the impression may be deeper into the block than is the case with an existing lead impression tool.

Figure 11:
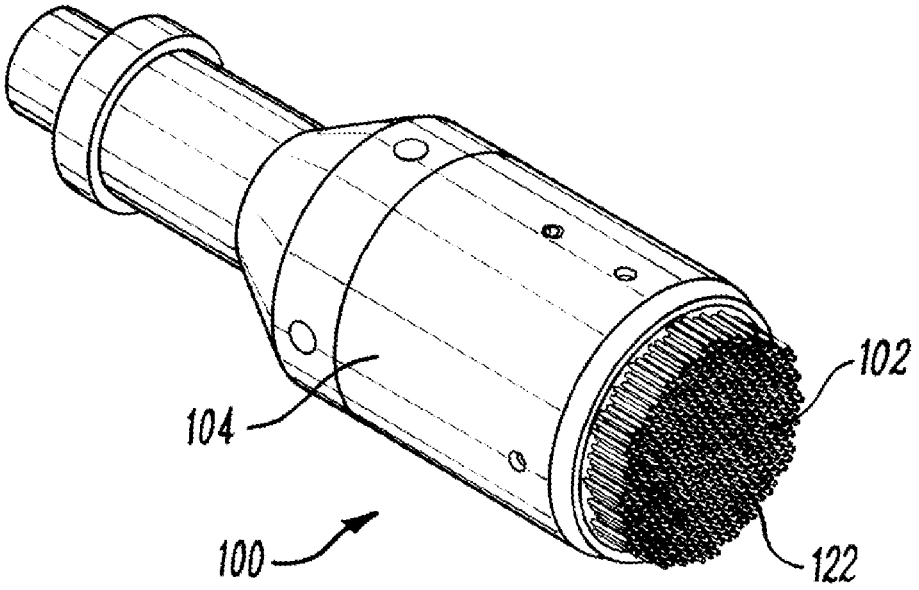
FIG. 11 is a perspective view of an alternative embodiment of an impression tool according to the present invention.
Figure 12:
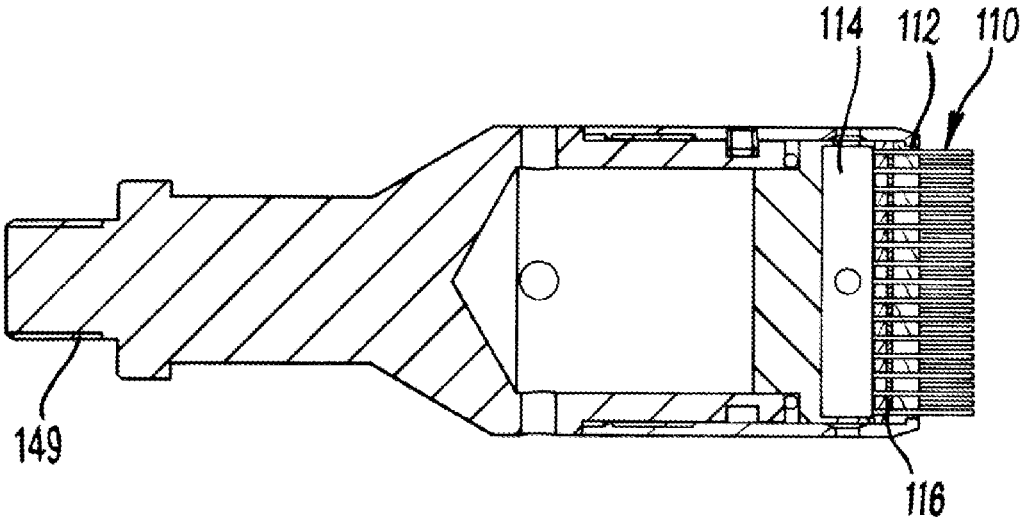
FIG. 12 is a cross-sectional elevation of the tool of FIG. 11.

Referring to FIGS. 11 and 12, there is shown a tool 100 for providing an impression of an object according to an alternative embodiment of the invention. The tool comprises a block 102 of pins 110 held by a gripper 104. The pins are arranged to be parallel to each other and are further arranged to be axially movable relative to a carrier 112 held by the gripper 102. Each pin may be for example 0.5 to 2 mm in diameter and preferably about 1 mm in diameter. The pins are preferably spaced apart by about 0.2 to 2 mm and more preferably about 1 mm. The pins may be arranged in a circular hexagonal, grid or another pattern.

The carrier 112 comprises a small recess sandwiched between the two plates. Within the recess is a silicone rubber sheet. In an embodiment the rubber sheet is poured and set during assembly of the tool. The rubber sheet provides resistance to the pins inadvertently moving, and also provides resistance to further movement after they have moved.

The block 102 has an impact face 122 which comprises free ends of the pins 110. Opposite and internal to the gripper 104 is a space 114 into which the pins may axially move. Opposite the free end, each pin has a captured end, which comprises a head so as to retain the pin in the block 102.

In operation the tool 100 is lowered down a borehole tethered to a cable or wire, such as a slickline, with the block 102 being down-hole first. When the tool 100 encounters an object the impact into the block 102 will deform the impression face 22 such that an impression is left in the block 102. This occurs by each of the impacted pins 110 moving inwardly into the space 114, so that collectively the pins 110 follow the contours of the object and thus form the impression. The tool 100 can then be retrieved and the impression examined to identify the impacted object.

The blocks 12, once used, may be kept as a permanent record of the investigative operation, recycled or disposed of. In the case of block 102, the pins may be reset and the block used again.

Figure 13:
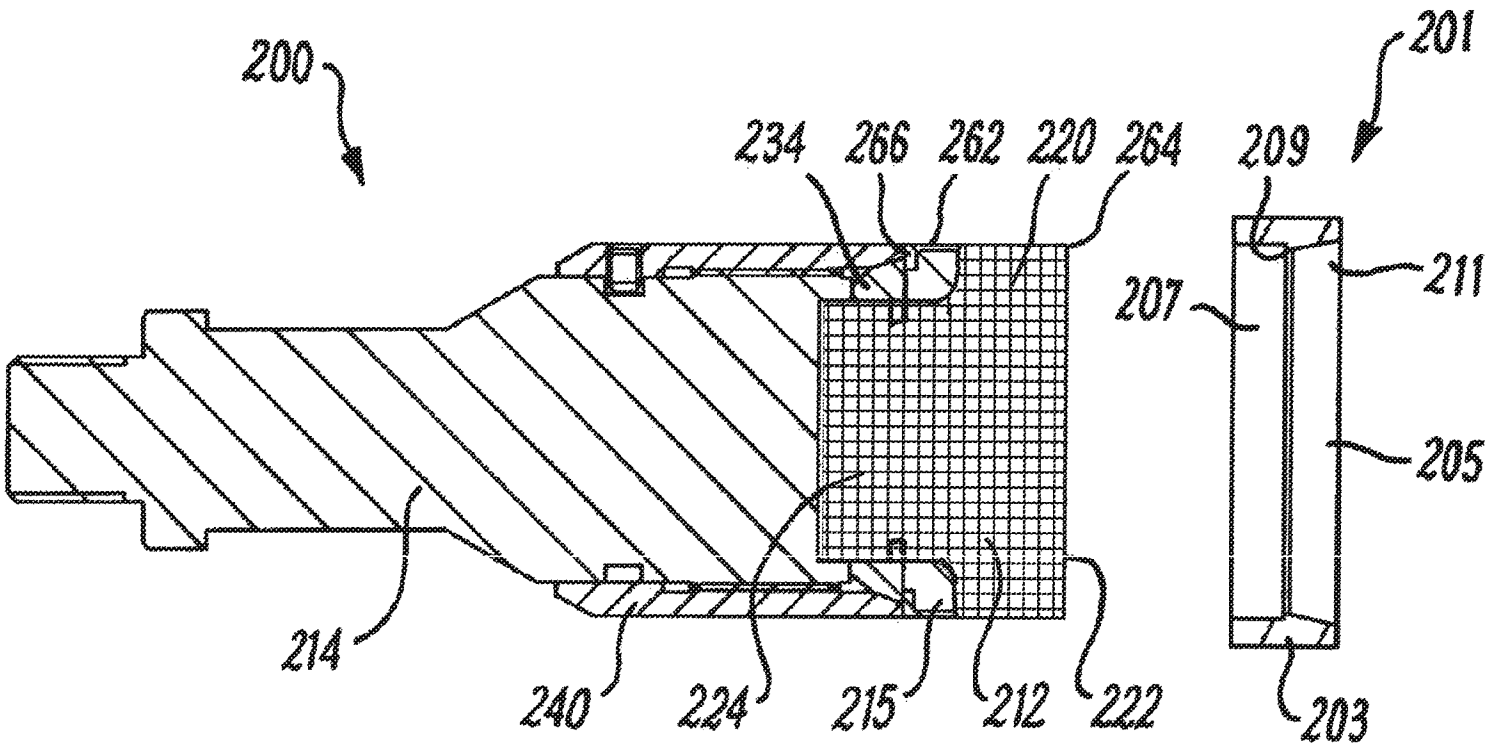
FIG. 13 is a cross-sectional view of an impression tool and assembly tool according to an alternative embodiment of the invention.
Figure 14:
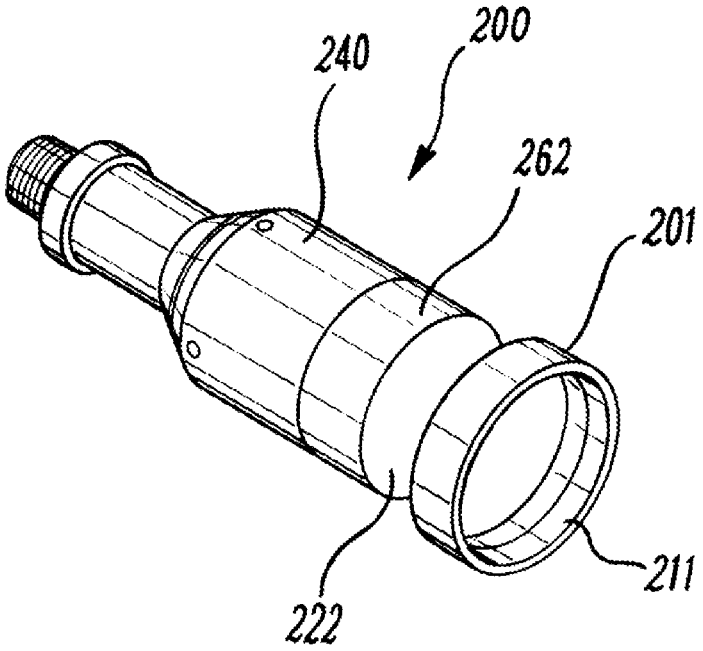
FIG. 14 is a perspective view of the impression tool and assembly tool of FIG. 13.

Referring to FIGS. 13 and 14, there is shown generally at 200 an impression tool according to an alternative embodiment of the invention. The impression tool 200 is similar to the impression tool 10 in many respects, and will be understood from FIGS. 2 to 10 and the accompanying description. Like components are given like reference numerals in FIG. 13, incremented by 200. The tool comprises a block 212 of knitted wire mesh held by a gripper assembly 214. The knitted wire mesh block 212 comprises a wire gage of approximately 0.15 mm knitted with a loop size of about 1 to 2 mm in diameter in a simple weft knitting pattern. The block 212 is shaped by rolling into a generally cylindrical shape, and comprises a relatively wide impression portion 220 at one end and a relatively narrow grip portion 224. The impact portion 220 defines an impact face 222 at one end of the tool, which faces downhole in use. The grip portion 224 is held into the gripper assembly by clamps 234, which are secured by sleeve 240. It will be apparent that the attachment mechanism illustrated and described for impression tool 200 is the same as the attachment mechanism illustrated and described with respect to the tool 10 of FIGS. 2 to 10.

The impression tool 200 differs from the impression tool 10 in that the tool 200 is provided with a protective element for the block 220 in the form of skirt member 262. The skirt member 262 functions to surround the impression portion 220 of the block 212. In this embodiment, the skirt member 262 extends around the entire circumference of the impression portion 220, and extends axially along the impression portion so that the edge of the skirt 262 is flush with the impression face 222. The outer diameter of the skirt 262 is flush with the outer diameter of the sleeve 240.

The inner surface of the edge 264 of the skirt member 262 is tapered slightly outwards to provide a lead-in profile for the insertion of the block 212 (as will be described in more detail below).

The opposing end of the skirt member 262 is provided with an engaging lip 266 which extends radially inward from the main inner diameter of the skirt 262. The engaging lip 266 provides a lower abutment shoulder, which cooperates with an enlarged portion 215 of the gripper 214. The opposing (upper) surface of the lip 266 abuts against the sleeve 240 and the clamps 234 when the tool is assembled, to secure the skirt member 262 into the gripper assembly.

The material of the skirt 262 is selected to be sufficiently robust to protect the outer edges of the mesh block 220 during use. Any suitable metal or alloy may be used for example, but in a preferred embodiment, the skirt 262 is formed from aluminium. Aluminium is selected as it provided the desired protection characteristics, but is sufficiently malleable to provide a visible impression of an object should the tool 200 impact the object at or close to the circumferential edge of the impression face 222. In alternative embodiments, other metals may be used, including but not limited to stainless steel.

The tool 200 is preferably assembled as follows. With the sleeve 240 and clamps 34 removed, the skirt member 262 is assembled over the gripper 214 until the lower shoulder of the lip 266 is in abutment with the enlarged portion 215 of the gripper 214. Without the clamps 234 in place, the sleeve 240 is assembled over the gripper to retain the skirt 262 in position with respect to the gripper.

The block 220, which is formed in accordance with the description of previous embodiments, is then inserted into the space defined by the gripper 214, the sleeve 240, and the skirt 262, with the aid of an assembly tool 201 (shown in FIGS. 13 and 14). The assembly tool 201 functions as an anti-swage ring for the skirt 262 during assembly. The tool 201 comprises a body in the form of a ring 203 defining an internal throughbore 205. The throughbore comprises a tool receiving section 207 which has an inner diameter corresponding to the outer diameter of the skirt 262. A shoulder 209 is provided in the tool receiving section to abut the edge 264 of the skirt 262. The opposing end of the tool 201 comprises a tapered section 211 which provides a lead-in profile for the insertion of the block 212. With the ring 201 positioned over the skirt 262, the block 220 can be inserted through the ring and forced into the space defined by the gripper 214, sleeve 240 and skirt 262. The tapered profile at the edge 264 reduces the chance of the block snagging or catching on the edge 264 during insertion.

With the block 212 fully inserted, the sleeve 240 is backed off to allow insertion of the clamps 234 through the slots in the gripper 214, as described in relation to previous embodiments of the invention. With the clamps 234 in position, the sleeve 240 is moved axially to force the clamps 234 radially inwards to grip the block. The sleeve is then secured and the tool is fully assembled.

The tool 200 is used in the same way as the tools 10 and 100, as described above. The skirt 262 provides a protective element for the block, which reduces or eliminates the prospect of the mesh block being damaged, removed or pulled from the assembled tool, for example due to the mesh catching on a protrusion, completion component or foreign body present in the borehole during run-in or retrieval.

The skirt member 262 is robustly secured in the tool by the engaging lip 266, which advantageously engages directly with the gripper assembly 214 and sleeve 240. The skirt also surrounds and is supported by the enlarged portion 215 of the gripper assembly. A benefit of this design is that the forces directed through the skirt 262 during use may be dissipated through the gripper and sleeve, which reduces any tendency that the skirt may otherwise have to shear from the engaging lip.

By selection of material for the skirt member (for example aluminium) the impression too can still create a useful impression of an object impacted at or close to the circumferential edge of the tool; the skirt will form an impression which can be inspected on retrieval.

The invention provides a tool for providing an impression of an object in a borehole. The tool comprises a block held by a gripper. The block comprises a plurality of discrete elements that deform or move so as to create an impression of an impacted object. In a preferred embodiment, the block is formed from a knitted wire mesh.

A general benefit of the invention is that the impression tool of the present invention requires no hazardous pouring of molten lead, nor any machining afterwards. The present invention is therefore more environmentally friendly for both manufacture and disposal compared to the existing lead impression tool. In addition, the impression tools of embodiments of the invention can be reused by replacement of the block, or, in the case of tool 100, resetting the position of the pins for subsequent use.

Modifications may be made to the present invention with the context of that described and shown in the drawings. Such modifications are intended to form part of the invention described in this specification.

The invention claimed is:

1. An impression tool for providing an impression of an object in a borehole, said tool comprising a block held by a gripper, wherein the block comprises a plurality of discrete elements that deform or move so as to create the impression, and wherein the block comprises a knitted wire mesh that is permanently deformed upon creation of the impression.

2. The tool according to claim 1, wherein the plurality of discrete elements of the block define an impression face and wherein the tool comprises one or more spaces behind the impression face of the block.

3. The tool according to claim 1, wherein the plurality of discrete elements comprises loops of the knitted wire mesh.

4. The tool according to claim 1, wherein the block comprises knitted wire having a gauge in the range of 0.05 mm to 0.5 mm.

5. The tool according to claim 1, wherein the block comprises knitted wire having a density in the range of 0.5 to 5 gram/cc.

6. The tool according to claim 1, wherein the block comprises knitted wire having a loop size of between 0.5 mm and 5 mm in diameter.

7. The tool according to claim 1, wherein the block comprises knitted wire having a weft knitting pattern.

8. The tool according to claim 1, wherein the block comprises knitted wire having a warp knitting pattern.

9. The tool according to claim 1, wherein the block comprises knitted wire having a consistent knit stitch knitting pattern.

10. The tool according to claim 1, wherein the block comprises knitted wire having an alternating knit stitch and purl stitch knitting pattern.

11. The tool according to claim 1, wherein the block is configured to be malleable in normal operating conditions.

12. The tool according to claim 1, wherein the block is configured to resist extrusion in normal operating conditions.

13. The tool according to claim 1, wherein the block comprises an impression portion projecting from the gripper and a grip portion, wherein the grip portion is of narrower diameter than the impression portion.

14. The tool according to claim 1, wherein the block is of substantially cylindrical form.

15. The tool according to claim 1, wherein the gripper comprises a carrier having a channel into which a portion of the block can be received.

16. The tool according to claim 15, wherein the gripper further comprises a plurality of clamps received within corresponding slots in the carrier, and the plurality of clamps are forced radially inward to grip the portion of the block.

17. The tool according to claim 16, wherein each clamp of the plurality of clamps is arc shaped and comprises a plurality of inwardly directed teeth.

18. The tool according to claim 16, wherein the gripper further comprises a sleeve into which the carrier and the plurality of clamps are received, and wherein the sleeve is radially disposed in relation to the plurality of clamps to force the plurality of clamps radially inward.

19. The tool according to claim 1, further comprising a protective element for the block.

20. The tool according to claim 19, wherein the protective element comprises a skirt member which at least partially surrounds the block.

21. The tool according to claim 20, wherein the block comprises and impression portion projecting from the gripper and the skirt member extends axially along the impression portion so that the edge of the skirt member is flush with an impression face of the block.

22. The tool according to claim 19, wherein the protective element is provided with an engaging formation which secures the protective element into the gripper.

23. The tool according to claim 19, wherein the protective element is configured to direct impact forces experienced in use to the gripper.

24. The tool according to claim 19, wherein the protective element is formed from a material selected to be malleable in normal operating conditions.

25. A block of knitted wire mesh for a borehole impression tool, the block comprising a grip portion suitable for being gripped by a gripper of the borehole impression tool, and an impact portion suitable for impacting an object in a borehole so as to create an impression of the object in the block, wherein the knitted wire mesh is permanently deformed upon creation of the impression.

26. The block according to claim 25, wherein the block comprises knitted wire having a gauge in the range of 0.05 mm to 0.5 mm.

27. The block according to claim 25, wherein the block comprises knitted wire having a density in the range of 0.5 to 5 gram/cc.

28. The block according to claim 25, wherein the block comprises knitted wire having a loop size of between 0.5 mm and 5 mm in diameter.

29. The block according to claim 25, wherein the block comprises an impression portion projecting from the gripper and the grip portion, wherein the grip portion is of narrower diameter than the impression portion.

30. A kit of parts for assembling an impression tool according to claim 1, the kit comprising:

a block comprising a plurality of discrete elements that deform or move so as to create an impression of an object in a borehole, wherein the block comprises a knitted wire mesh; and a gripper to hold the block.

31. The kit of parts according to claim 30 further comprising a protective element for the block.

32. The kit of parts according to claim 30 further comprising an assembly tool, the assembly tool comprising an anti-swage ring for the protective element during assembly of the block into the gripper.

* * * * *